US005762188A

United States Patent [19]

Nishimura

[11] Patent Number: 5,762,188

[45] Date of Patent: Jun. 9, 1998

[54] GOLF BAG WITH AN EXPANDABLE UPPER PORTION

[75] Inventor: Toshinori Nishimura, Hiratsuka, Japan

[73] Assignee: The Yokohama Rubber Co., Ltd., Tokyo, Japan

[21] Appl. No.: 752,145

[22] Filed: Nov. 19, 1996

[30] Foreign Application Priority Data

Nov. 20, 1995 [JP] Japan ..... 7-301551

[51] Int. Cl.[6] ..... A63B 55/00

[52] U.S. Cl. ..... 206/315.4; 150/159

[58] Field of Search ..... 206/315.2–315.8; 150/159

[56] References Cited

U.S. PATENT DOCUMENTS

| | | | |
|---|---|---|---|
| 725,764 | 4/1903 | Pierce | 206/315.4 |
| 1,617,115 | 2/1927 | Hotze | 206/315.4 |
| 1,644,592 | 10/1927 | Howland | 206/315.4 |
| 2,509,195 | 5/1950 | Barron | 206/315.6 X |
| 3,053,298 | 9/1962 | Stamp | 206/315.2 |
| 3,059,681 | 10/1962 | Lorbeski | 206/315.4 X |
| 4,512,465 | 4/1985 | Jobe | 206/315.4 |
| 4,788,996 | 12/1988 | Forshee | 206/315.4 X |
| 5,469,960 | 11/1995 | Yuill | 206/315.6 X |
| 5,540,431 | 7/1996 | Crozier | 206/315.3 X |

FOREIGN PATENT DOCUMENTS

| | | | |
|---|---|---|---|
| 2452 | 9/1911 | United Kingdom | 206/315.3 |
| 6415 | 8/1913 | United Kingdom | 206/315.7 |

*Primary Examiner*—Sue A. Weaver

*Attorney, Agent, or Firm*—Finnegan, Henderson, Farabow, Garrett & Dunner

[57] ABSTRACT

A golf bag comprises a bottomed cylindrical bag body, and a cylindrical unit provided on an upper end portion of the bag body, this cylindrical unit having as main constituent parts a plurality of skeletal members arranged circularly. The cylindrical unit is formed so that it is expanded and contracted radially at its upper portion with the lower end portions of the skeletal members used as fulcrums. Owing to this construction, damage to the club heads and the breakage of a hood by the head edges of iron type golf clubs due to the vibration occurring during the transportation of the bag can be prevented. Moreover, the withdrawing and inserting of golf clubs from and into the bag can be done more smoothly.

9 Claims, 5 Drawing Sheets

GOLF BAG WITH AN EXPANDABLE UPPER PORTION

BACKGROUND OF THE INVENTION

This invention relates to a golf bag for carrying golf clubs, and more particularly to a golf bag which, during the transportation thereof, prevents the damage to club heads due to their collisions and the breakage of the hood of the bag by the head edges of irons.

In general, a golf bag is formed into a bottomed cylinder, which is somewhat shorter than the shortest golf club so that the heads of all clubs may project through its upper opening to make it easy to take them out or put them in the bag. When the bag is carried, a hood fixed detachably to the upper opening is closed so that the golf clubs do not slip out from the bag. The golf club bag usually holds a series of about 14 golf clubs comprising woods, irons and a putter.

However, in order that the golf clubs held in such a golf club bag can be withdrawn from and inserted into the bag smoothly, they are set so as to be movable to a certain extent in the bag. Accordingly, when the bag holding golf clubs receives a great rolling and vibratory force during the transportation, the club heads collide with one another and are damaged. The irons break the hood for the bag at their head edges.

SUMMARY OF THE INVENTION

An object of the present invention is to provide a golf bag, which protects club heads from damage and prevents the head edges of irons from breaking the hood of the bag if there are mechanical vibrations and the like during the transportation there of.

Another object of the present invention is to provide a golf bag which enables the golf clubs to be withdrawn and inserted more smoothly.

A golf bag which achieves these objects is characterized in that a cylindrical unit formed of a plurality of circularly arranged skeletal members as main constituent parts thereof is provided on an upper end portion of a bottomed cylindrical bag body, the skeletal members being formed pivotably around their lower portions as fulcrums so that an upper portion of the cylindrical unit can be diametrically expanded and contracted.

Since the upper portion of the cylindrical unit thus provided on the bag body is formed expansibly and contractibly in the diametrical direction thereof, the upper end portions of the shafts of the golf clubs held in the bag can be collected in a central portion of the bag by squeezing the upper portion of the cylindrical unit in the diametrically inward direction, whereby the head portions of the golf clubs can be placed under restraint. Since the movement of the club heads is thus restricted, the collision of the club heads with one another and the striking of the club heads at the hood for the bag can be avoided even when the golf club bag receives great rolling and vibratory force during the transportation thereof. Consequently, the damage to the club heads and the breakage of the hood by the head edges of iron type golf clubs can be prevented.

The inlet of this golf bag can be opened larger than that of a conventional bag of this kind by expanding the upper end portion of the cylindrical unit in the diametrically outward direction. Accordingly, the withdrawing and inserting of golf clubs from and into the bag during a play and a practice can be done more smoothly than in a case where a conventional golf bag is used.

BRIEF DESCRIPTION OF THE DRAWINGS

FIG. 4(*b*) is a drawing taken along the arrowed line 4(*b*)—4(*b*) in FIG. 4(*a*);

FIG. 5(*b*) is a front view showing the upper end portion of the cylindrical unit expanded to a diameter equal to that of the bag body;

FIG. 5(*c*) is a front view showing a contracted state of the upper end portion of the cylindrical unit; FIG. 5(*d*) is a plan view of what is shown in FIG. 5(*c*);

DESCRIPTION OF THE PREFERRED EMBODIMENTS

Figure 1:
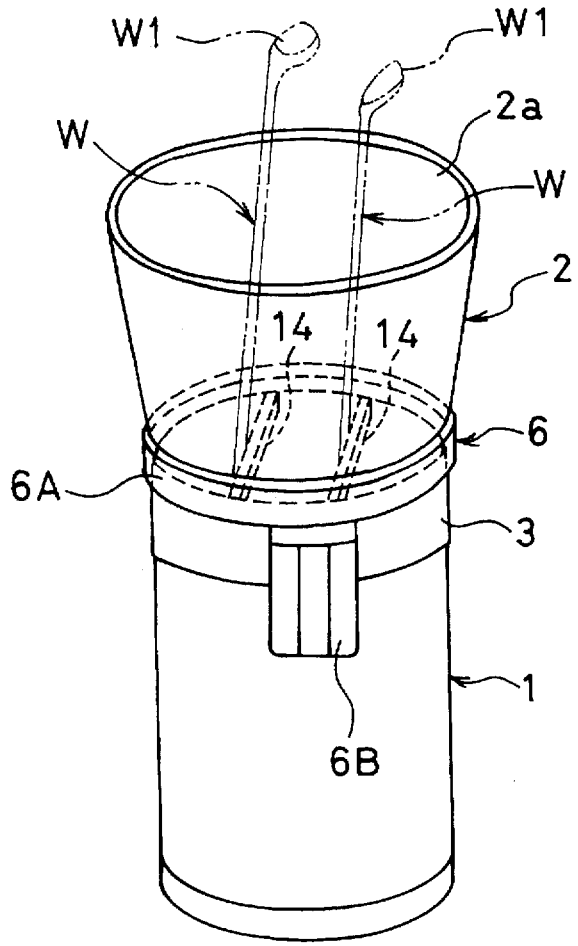
FIG. 1 is a perspective view showing an example of the golf bag according to the present invention.

As shown in FIG. 1, the golf bag according to the present invention is provided with a bag body 1 holding golf clubs W therein, and a cylindrical unit 2 provided on the bag body.

Figure 2:
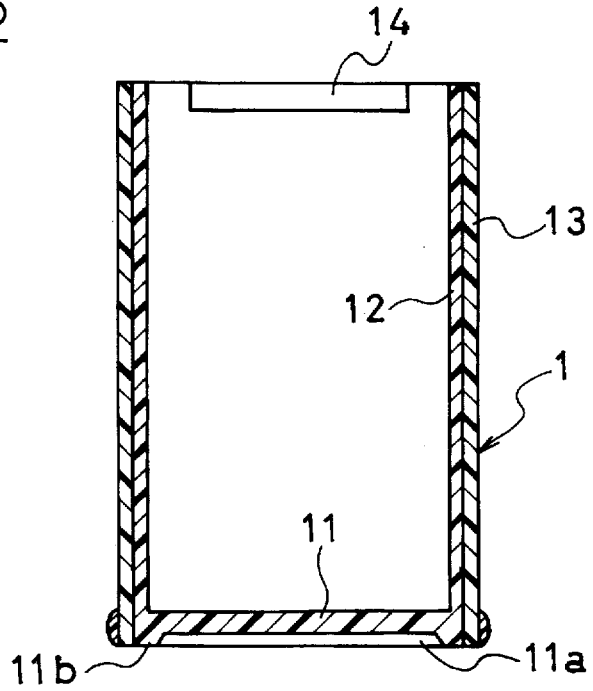
FIG. 2 is a sectional view of a bag body.

As shown in FIG. 2, the bag body 1 has a round bottom plate 11, and a cylindrical portion 12 set up vertically on a peripheral part of and joined to the bottom plate 11 so as to become integral therewith, and it is formed to the bottomed cylinder with an upper opening. A lower surface of the bottom plate 11 is provided with a recess 11*a*, and an outer circumferential portion of the lower surface forms a leg 11*b*. A flexible cover 13 is put on the whole of the outer surface of the bag body which extends from the lower end of the bottom plate 11 to the upper end of the cylindrical portion 12. Two partition bars 14 dividing an inlet of the bag are provided horizontally between opposite upper end parts of the cylindrical portion 12 so that the bars 14 are spaced from each other by a predetermined distance. These partition bars 14 prevent the golf clubs W held in the bag from gathering in one place. At least one partition bar 14 may be provided in accordance with the size of the inlet of the bag.

Figure 3:
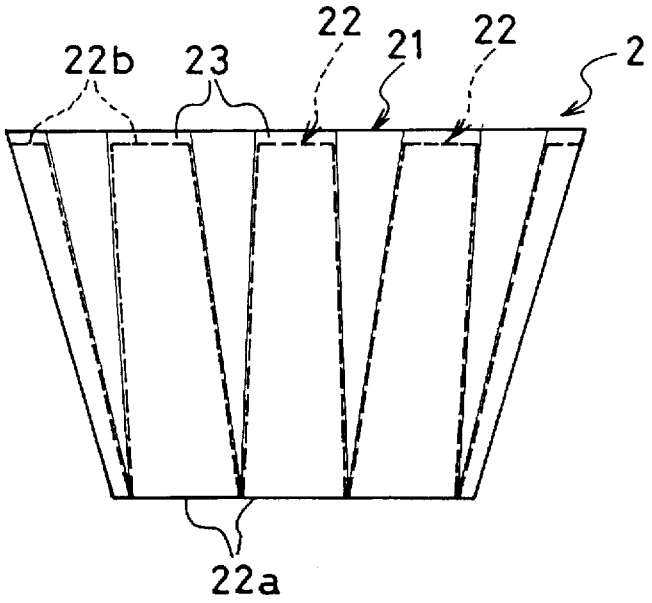
FIG. 3 is a front view of a cylindrical unit fixed to an upper end of the bag body.
Figure 4A:
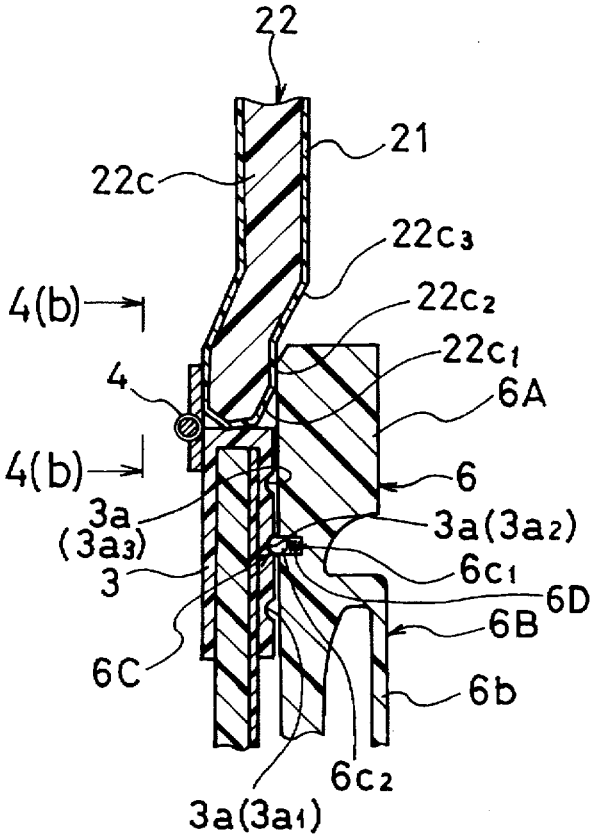
FIG. 4(*a*) is an enlarged sectional view of an upper end portion of the body of the golf bag according to the present invention.
Figure 4B:
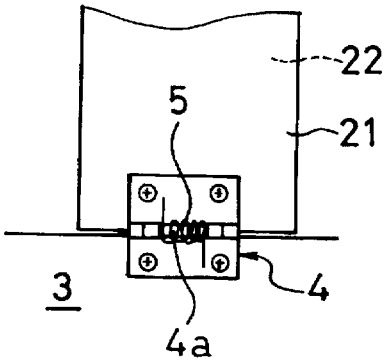
Figure 5A:
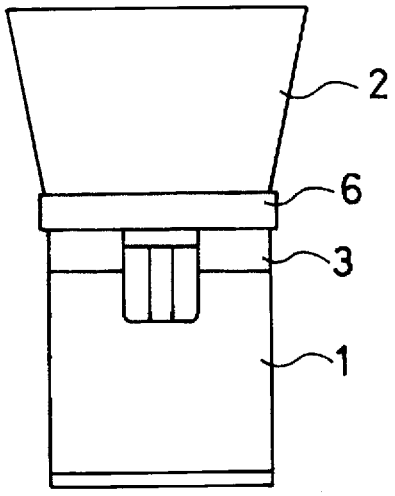
FIG. 5(*a*) is a front view showing an expanded state of an upper end portion of the cylindrical unit.
Figure 5B:
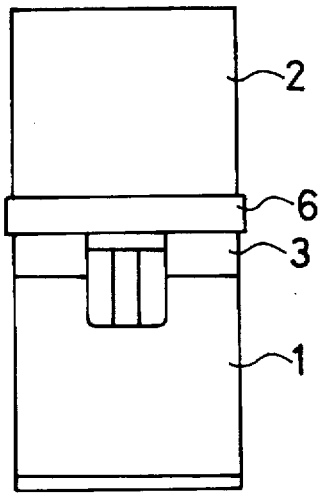
Figure 5C:
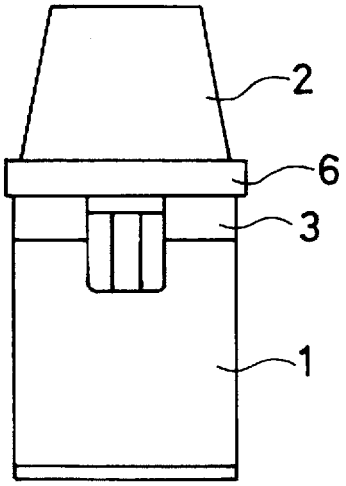
Figure 5D:
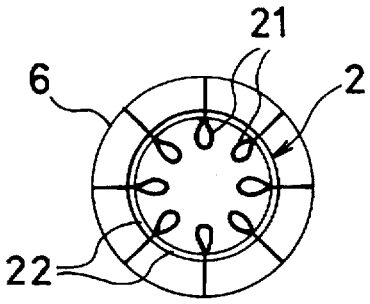

As shown in FIG. 3, the cylindrical unit 2 has a deformable cylindrical shape in which an upper end part can be expanded and contracted with respect to a lower end part thereof retained in the shape that is identical with that of the inlet of the bag. The cylindrical unit 2 comprises a flexible cover 21 shaped like an inverted frustum of a cone, and a plurality of circularly arranged elongated trapezoidal or rectangular plates 22. The cover 21 is provided with a plurality of bag-like storage chambers 23 arranged in the circumferential direction thereof, and the plates 22 are inserted fixedly in these storage chambers 23. Each of the plates 22 is formed so as to have an arcuate cross section. A lower edge 22*a* of each plate 22 is formed to a radius of curvature equal to that of a corresponding arcuate portion of an upper edge of the cylindrical portion 12, and the radius of curvature of an upper edge 22*b* of the plate is set smaller than that of the lower edge 22*a*. As shown in FIG. 4(*a*), a lower end portion 22*c* is formed cross-sectionally in such a manner that it has two upwardly expanded tapering outer surfaces $22c_1$, $22c_3$ and one vertical outer surface $22c_2$. This vertical surface $22c_2$ is positioned between the tapering surfaces $22c_1$, $22c_3$.

A ringlike mounting rim 3 for mounting the cylindrical unit 2 is fitted fixedly around an upper circumferential edge portion of the bag body 1. Each plate 22 is fixed to the mounting rim 3 via a hinge 4 as shown in FIG. 4(*a*), in such a manner that the plate 22 can be turned radially around its lower end as a fulcrum. In each hinge 4 a spring means such as a, a coiled spring 5 is fitted around a hinge shaft 4*a* so that both end portions of the coiled spring 5 are engaged with the surfaces of the hinge 4 as shown in FIG. 4(*b*). This coiled spring 5 urges each plate 22 so that the plate 22 is turned at its upper portion in the radially outward direction.

A restriction member 6 for restricting the inclination of the plates 22 in the radially outward direction is provided on the outer circumferential parts of joint portions of the bag body 1 and cylindrical unit 2. This restriction member 6 is provided with a ring-shaped restriction portion 6A and a handle portion 6B provided with a handle 6*b*. The restriction portion 6A is fitted vertically slidably around an outer circumference of the mounting rim 3, and engaged at an upper part thereof at all times with the outer surface of the lower end portions 22*c* of the outwardly urged plates 22 so as to restrict the outward inclination of the plates 22. The handle portion 6B is integral with the restriction portion 6A and joined to one side of the restriction portion 6A so as to project downward. A locking means such as a small retractable projection 6C is provided in an upper part of an inner surface of the handle portion 6B so that the projection 6C can be engaged with recesses 3*a* formed in an outer circumferential surface of the mounting rim 3. The small retractable projection 6C comprises a coiled spring $6c_1$ provided in a bore 6D, and a ball $6c_2$ provided on a free end of the coiled spring $6c_1$. The ball $6c_2$ is urged by the coiled spring $6c_1$ in the direction in which the ball moves outside the bore 6D.

Three recesses 3*a* are arranged in line in the vertical direction. When the small retractable projection 6C is engaged with the lower recess $3a_1$, the upper part of the restriction portion 6A engages the lower tapering surfaces $22c_1$ of the lower end portions of the plates. Consequently, the upper portion of the cylindrical unit 2 is expanded to a diameter greater than that of the bag body 1 as shown in FIG. 5(*a*). When the small retractable projection 6C is engaged with the intermediate recess $3a_2$, the upper part of the restriction portion 6A engages the vertical surfaces $22c_2$ of the lower end portions of the plates. Consequently, the diameter of the cylindrical unit 2 and that of the bag body 1 become equal to each other as shown in FIG. 5(*b*). When the small retractable projection 6C is engaged with the upper recess $3a_3$, the upper part of the restriction portion 6A engages the upper tapering surfaces $22c_3$ of the lower end portions of the plates. Consequently, the upper portion of the cylindrical unit 2 is contracted to a diameter smaller than that of the bag body 1 as shown in FIG. 5(*c*). When the cylindrical unit 2 is thus contracted, the portions of the cover 21 which are positioned among the pivotable plates 22 become bent radially inward as shown in FIG. 5(*d*).

As shown in FIG. 1, when one set of golf clubs is held in the above-described golf bag, the club heads project somewhat above the upper opening 2*a* of the cylindrical unit 2. A hood (not shown) for protecting the club heads while the cylindrical unit is contracted is attached to the upper end portion of the cylindrical unit 2.

According to the golf bag of the present invention described above, the small projection 6C is engaged with the upper recess $3a_3$ by gripping the handle 6*b* and moving up the restriction member 6. Consequently, the restriction portion 6A presses the plates 22 radially inward, so that the upper portion of the cylindrical unit 2 is contracted as shown in FIG. 5(*c*). Therefore, the upper end portions of the shafts which are in the vicinity of the heads of the golf clubs W held in the bag are collected under restraint in the central portion of the bag, whereby the golf clubs W can be kept from moving in the bag. Accordingly, the collision of the club heads with one another and the striking of the club heads at the hood can be avoided even when the bag receives a large rolling or vibratory force during the transportation of the bag. As a result, the club heads are not easily damaged. It also becomes possible to avoid the occurrence of breakage of the hood which is easily caused by the edges of iron type golf club heads.

The small retractable projection 6C is engaged with the lower recess $3a_1$ by moving down the restriction member 6. The engaging position of the restriction portion 6A is then transferred to the lower end-side tapering surfaces $22c_1$ of the plates 22, and the upper portion of the cylindrical unit 2 is expanded as shown in FIG. 5(*a*). Since the inlet of the bag thus becomes larger than that of a conventional bag, the withdrawing and inserting of golf clubs W from and into the golf bag can be done more smoothly during a golf competition and a practice in golf.

According to the present invention, the bottom plate 11 and cylindrical portion 12 of the bag body 1, mounting member 3 and restriction member 6 can preferably be formed out of synthetic resins or small weight metal materials so as to meet the weight reduction requirement. For example, polypropylene resin, polyethylene resin and acrylonitrile-butadiene-styrene copolymer as synthetic resins and aluminum and duralumin as small weight metal materials can be preferably used.

The cover 13 for the bag body 1 and the cover 21 for the cylindrical unit 2 may be formed of, for example, a woven cloth of organic fiber in view of the necessity of reducing the weight thereof. For example, nylon, polyester and polyvinyl chloride can be used preferably as the organic fibers of the woven cloth.

The plates 22 may also be formed out of synthetic resins so as to reduce the weight thereof, and hard resins, such as polypropylene resin, polyethylene resin and acrylonitrile-butadiene-styrene copolymer can preferably be used. Instead of the resins, small weight metal materials may be used. For example, aluminum and duralumin can preferably be used.

Figure 6:
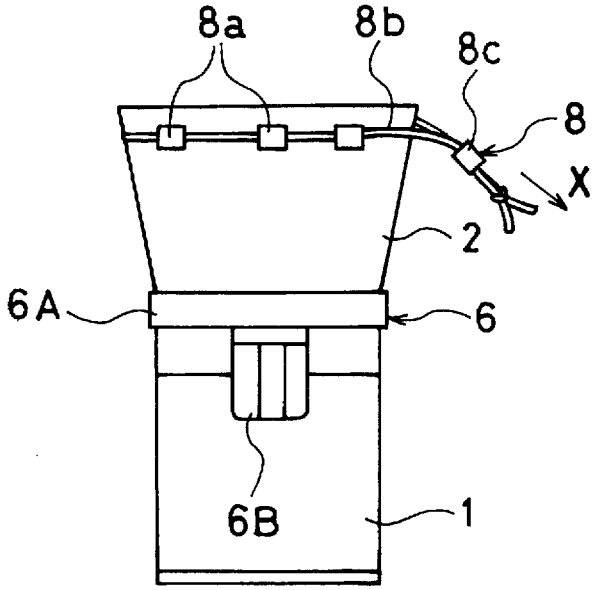
FIG. 6 is a front view showing another example of the golf bag according to the present invention.
Figure 7:
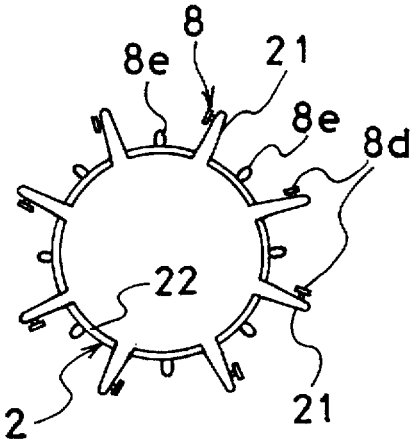
FIG. 7 is an explanatory plan view showing still another example of the golf bag according to the present invention.
Figure 8:
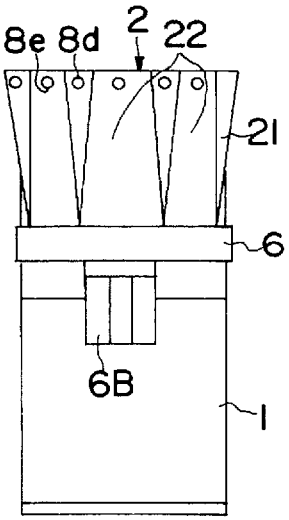
FIG. 8 is a front view of the golf bag of FIG. 7.
Figure 9:
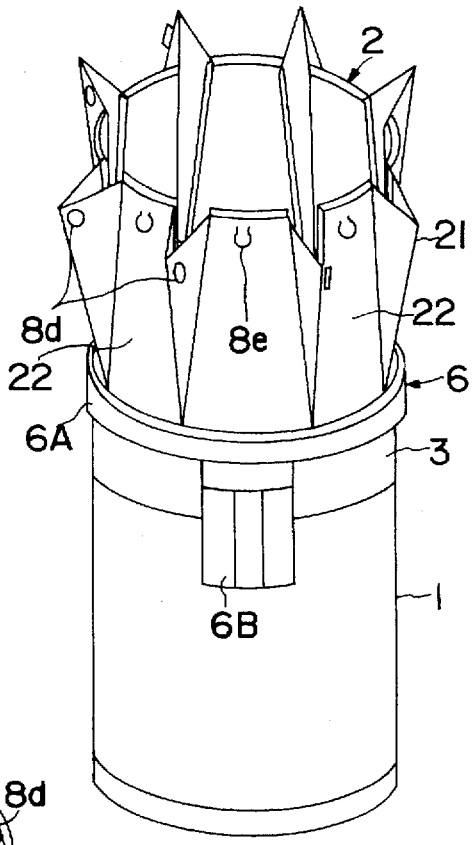
FIG. 9 is a perspective view of the golf bag of FIG. 7.

FIG. 6 shows another example of the bag for golf clubs according to the present invention. This example differs from the above-described embodiment in that a restriction member 6 is fixed to a mounting rim 3 at a position equivalent to the position in FIG. 4*a* where the small retractable projection 6C is engaged with lower recesses $3a_1$ (the cylindrical unit is an expanded state) and is set to be immovable, with a retainer means 8 for retaining an expanded or contracted state of a cylindrical unit 2 being provided.

This retainer means 8 comprises ring members 8*a* fixed to an outer circumferential surface of an upper portion of a cover 21 so that the ring members 8*a* are spaced at predetermined intervals in the circumferential direction of the cover, an endless string 8*b* passes through these ring members 8*a* and knotted up at both end portions, and a stopper 8*c* fixed to the string 8*b*. The string 8*b* is pulled in the direction of arrow X so as to contract the cylindrical unit 2, and the stopper 8*c* is then moved toward the left side of the drawing until the stopper 8*c* contacts the cylindrical unit 2, whereby the cylindrical unit 2 can be retained in a contracted state. Even when the bag is formed in this manner, the same effect as mentioned above can be obtained.

According to the present invention, a bag identical with the embodiment of FIG. 6 in which the restriction member 6 is formed movably in the same manner as in the embodiment of FIG. 1 may be also used. After the cylindrical unit 2 is contracted by the restriction member 6, the resultant condition is retained by the retainer member 8. Therefore, even when the small retractable projection 6C is disengaged by accident from the recess $3a_3$ during the transportation of the bag, the contracted condition of the cylindrical unit 2 can be retained. Accordingly, the damage to the club heads and the breakage of the hood due to the head edges of irons can be reliably prevented.

Figure 12:
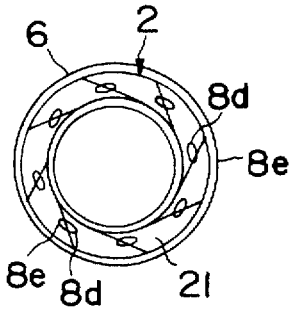
FIG. 12 is a plan view of the golf bag of FIG. 11.
Figure 10:
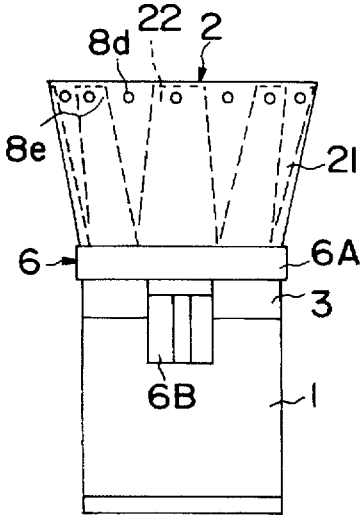
FIG. 10 is a front view of the golf bag of FIG. 7 showing an expanded state of the upper end portion of the cylindrical unit.
Figure 11:
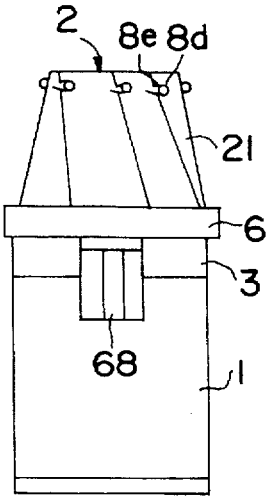
FIG. 11 is a front view of the golf bag of FIG. 7 showing a contracted state of the upper end portion of the cylindrical unit with the retainer means engaged.

The retainer means 8 of the above-described construction in the embodiment in which both the movably formed restriction member 6 and the retainer means 8 are provided may be replaced as shown in FIGS. 7–12 by a combination of buttons 8*d* and ring shaped locking members 8*e* such as loops with which the buttons 8*d* are to be engaged. In this embodiment, the portions of the cover 21 which are between the plates 22 are pulled outward when the cylindrical unit 2 is contracted see FIGS. 7–9. The buttons 8*d* are fixed to the parts of the cover 21 which are in the vicinity of the portions thereof pull out. The locking members 8*e* are attached to the parts of the cover 21 which correspond to the plates 22. The cylindrical unit Z can then be secured in the contracted state by engaging the buttons 8*d* with the locking members 8*e* as shown in FIGS. 11 and 12. FIG. 10 shows the cylindrical unit in the expanded state.

Although the restriction member 6 in these embodiments is made movable among three vertical positions, it may be made movable at least between two vertical positions in which the recesses $3a_1$, $3a_3$ are provided.

When the retainer means 8 is formed as shown in FIG. 6, the stopper 8*c* may not necessarily be provided, and the contracted condition of the cylindrical unit may be retained by knotting the string 8*b* pulled in the direction of the arrow X.

According to the present invention, a plurality of arms may be provided instead of the plates 22 so that the arms are urged in the radially outward direction. It is needless to say that the plates 22 and arms are not limited to the above-described construction as long as they comprise skeletal members formed so that they can be radially expanded and contracted.

As described above, the present invention enables the end portions of the shafts of the golf clubs held in the bag to be collected under restraint in the central portion of the bag by contracting the upper portion of the cylindrical unit joined to the bag body in the radially inward direction, and the movement of the head portions of the golf clubs to be thereby suppressed. Therefore, the collision of the club heads with one another and the striking of the club heads at the hood can be prevented. Accordingly, the damage to the club heads and the breakage of the hood due to the head edges of irons can be prevented.

The inlet of the golf bag can be widened as compared with that of a conventional bag of this kind by expanding the upper portion of the cylindrical unit in the radially outward direction. Therefore, the withdrawing and inserting of golf clubs from and into the bag can be done more smoothly during a golf competition and a practice in golf.

What is claimed is:

1. A golf bag comprising a cylindrical bag body having an axis, a closed bottom and a deformable cylindrical unit mounted on an upper end portion of said body, said cylindrical unit comprising a plurality of circularly arranged skeletal members each having a lower end and an upper end, the lower ends of the members being pivotally mounted around the upper end portion of the cylindrical bag body so that the members are moveable between a position where the upper ends of the members are expanded outwardly in a radial direction with respect to the axis of the bag body and a position where the upper ends of the members are contracted inwardly in said radial direction.

2. The golf bag of claim 1, wherein said skeletal members of said cylindrical unit are plates.

3. The golf bag of claim 2, wherein said cylindrical unit includes a flexible cover within which said plates are fixed.

4. The golf bag of claim 3, wherein said plates are pivotally mounted at the lower ends thereof to the upper end portion of said bag body by hinges so that said plates can be pivoted in the radial direction of said bag body, and wherein said cylindrical unit includes spring means for urging the upper ends of the plates outwardly and a restriction member mounted for vertical movement on an outer circumferential portion of the upper end portion of said bag body to restrict and vary the outward movement of said plates in opposition to the spring means.

5. The golf bag of claim 4, wherein each of said plates has on an outer side of the lower end thereof, two upwardly expanding tapering surfaces and a vertical surface between said tapering surfaces, said restriction member being configured and mounted so as to be selectively brought into contact with said surfaces to thereby vary the outward movement of said plates.

6. The golf bag of claim 5, including locking means for locking the restriction member in a plurality of positions in the path of vertical movement thereof, so that the plates and cover of said cylindrical unit can be held in an expanded position or a contracted position.

7. The golf bag of claim 3, including retainer means for retaining said plates and cover of said cylindrical unit in the contracted position mounted on an outer circumferential surface of an upper portion of the cover of said cylindrical unit.

8. The golf bag of claim 7, wherein said retainer means comprises ring members fixed to the outer circumferential surface of said upper portion of the cover of said cylindrical unit so that said ring members are spaced from one another at predetermined intervals in the circumferential direction of said cylindrical unit, and at least one string passing through said ring members that can be tightened to thereby retain said plates and cover of said cylindrical unit in the contracted position.

9. The golf bag of claim 7, wherein said retainer means comprises buttons fixed to outer portions of said cover that are located between said plates and that project outwardly from between the plates when the plates are in the contracted position and ring-shaped locking members on outer portions of said cover which correspond to said plates, whereby the buttons can be engaged with the locking members to thereby retain said plates and cover of said cylindrical unit in the contracted position.

* * * * *